US005454321A

United States Patent [19]

Biggs et al.

[11] Patent Number: 5,454,321

[45] Date of Patent: Oct. 3, 1995

[54] FAULT TOLERANT SAFE AND ARMING DEVICE

[76] Inventors: Bradley M. Biggs, 143 S. La Arborleta, Gilbert, Ariz. 85296; Steve M. Curtis, 843 S. Longmore, #2188, Mesa, Ariz. 85202; Robert H. Johnson, 11833 N. 64th St., Scottsdale, Ariz. 85254

[21] Appl. No.: 324,210

[22] Filed: Oct. 17, 1994

[51] Int. Cl.[6] ..... F23Q 13/00

[52] U.S. Cl. ..... 102/219

[58] Field of Search ..... 102/219, 218, 102/202.8, 202.14

[56] References Cited

U.S. PATENT DOCUMENTS

| | | | |
|---|---|---|---|
| 1,917,418 | 7/1933 | Almquist et al. | 361/200 |
| 2,363,531 | 11/1944 | Johnson | 313/37 |
| 2,696,103 | 12/1954 | Heilprin et al. | 73/5 |
| 2,999,179 | 9/1961 | Bianchi et al. | 313/146 |
| 3,009,077 | 11/1961 | Jacob | 313/596 |
| 4,882,993 | 11/1989 | Schwartzman | 102/218 |
| 5,123,356 | 6/1992 | Brooks et al. | 102/275.12 |

*Primary Examiner*—Charles T. Jordan
*Assistant Examiner*—Christopher K. Montgomery

[57] ABSTRACT

An electronic safe and arming device includes an enclosure (11) which has a circuit (16) for enabling a detonator (26). The circuit (16) has a sealed tube switch (17) which is pressurized with a gas mixture. The enclosure (11) is pressurized with substantially the same gas mixture (19) and pressure as in the tube switch (17). Safe and arm electronics control (20) triggering the tube switch (17) to set off a detonator (26) which in turn sets off an explosive charge. As a result the present safe and arming device is single fault tolerant.

15 Claims, 2 Drawing Sheets

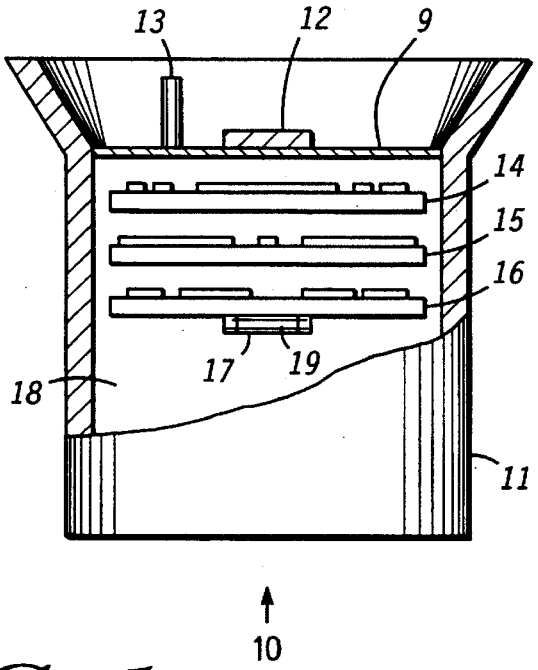
FIG. 1
FIG. 2
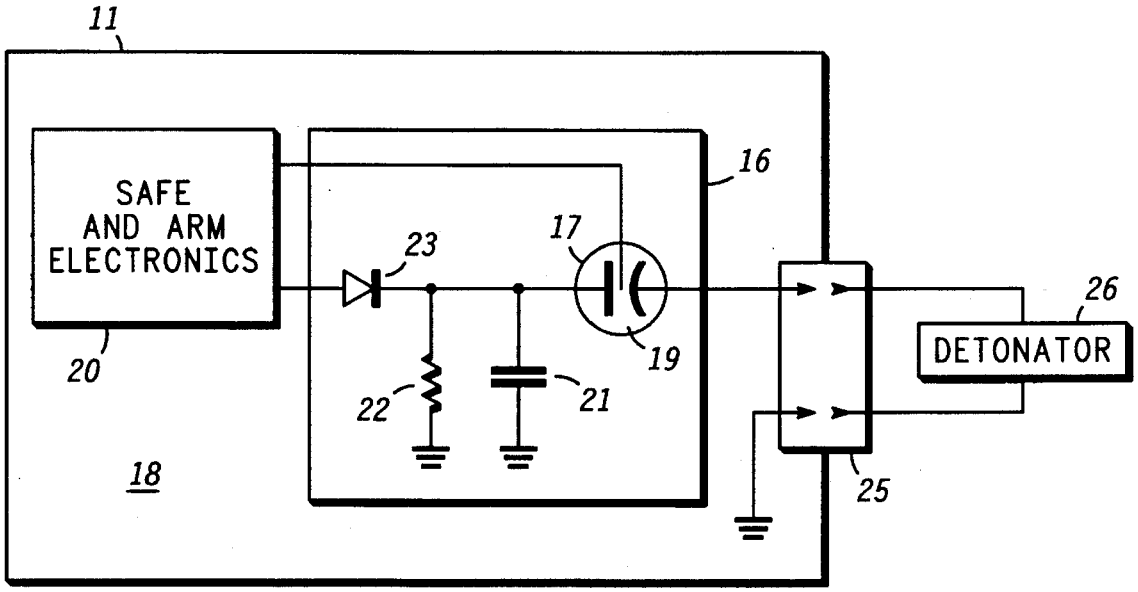

FAULT TOLERANT SAFE AND ARMING DEVICE

BACKGROUND OF THE INVENTION

The present invention pertains to safe and arming devices and more particularly to fault tolerant electronic safe and arming devices.

The purpose of safe and arming devices is twofold. First the safe and arming device provides for safely storing an explosive device so that it does not detonate prematurely. Second, the safe and arming device arms a detonator of an explosive charge so that the detonator may set off the explosive charge at the desired time.

Electronic safe and arming devices are being developed to replace mechanical and electro-mechanical safe and arming devices for most modern weapons systems. These electronic safe and arming devices typically include a high voltage capacitor, a detonator, triggering electronics and a trigger switch. The triggering electronics send a trigger signal to the trigger switch, commonly implemented with a tube switch, and causes the high voltage capacitor to be charged. When the trigger signal operates the tube switch, the charge stored in the capacitor is transmitted through tube switch to set off the detonator and the subsequent explosive charge.

The tube switch is pressurized with a particular gas mixture and sealed from its environment. The tube is located within the safe and arming device. The tube switch is controlled by the gas mixture and the pressure within the tube switch. If the tube switch leaks, its operating characteristics change. The tube switch can leak in long term storage and cause premature detonation of the explosive device. Destruction of the device delivering the explosive, such as a plane, or explosion substantially far away from a target may result. Either result is undesirable.

Accordingly, it would be desirable to have a fault tolerant safe and arming device.

BRIEF DESCRIPTION OF THE DRAWING

FIG. 1 is a cross section view of an electronic safe and arming device in accordance with the present invention.

FIG. 2 is a schematic view of an electronic safe and arming device and detonator in accordance with the present invention.

DESCRIPTION OF THE PREFERRED EMBODIMENT

Figure 3:
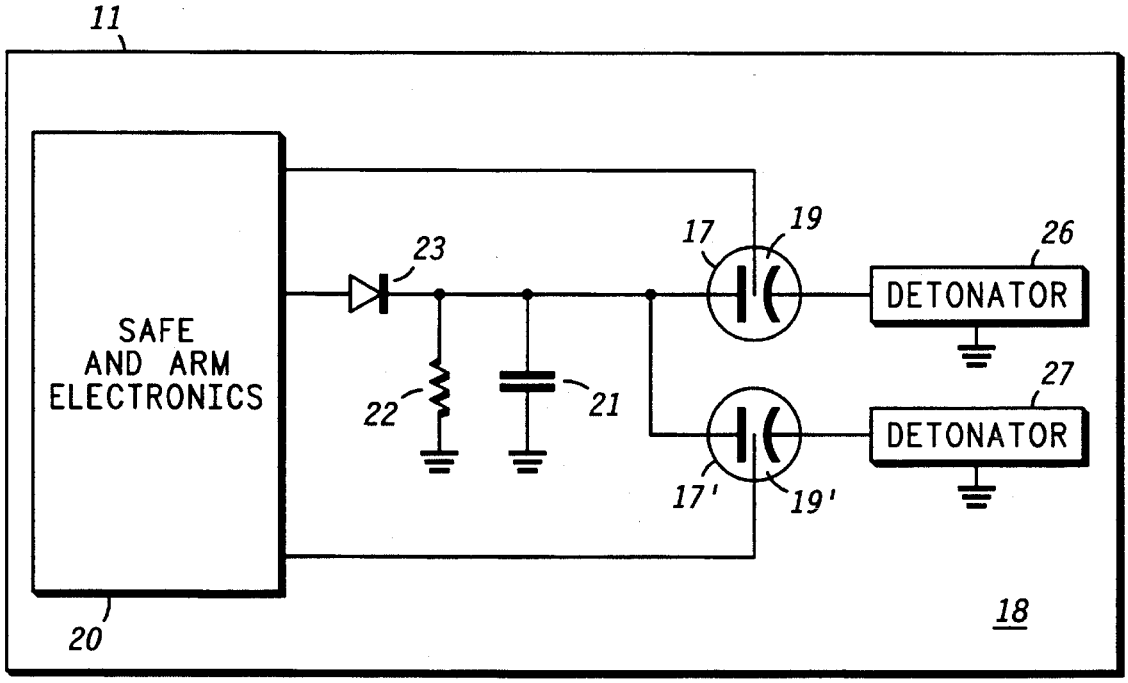
FIG. 3 is a schematic view of a multiple detonator configuration of an electronic safe and arming device in accordance with the present invention.

The present invention, in its preferred embodiment, relates to an Electronic Safe and Arm Device (ESAD) high voltage gas tube switch used to initiate explosives at the proper time. The tube switch or entire ESAD is enclosed into a hermetically sealed, backfilled container to maintain the proper gas level in the spark gap of the tube switch. This results in increased safety and required long shelf life.

The key elements of the present ESAD invention are as follows:

a) The tube switch or entire ESAD is enclosed in a hermetic container;

b) The container is backfilled with the same gas as used in the tube switch;

c) The container is pressurized to the same pressure as the gas in the tube switch;

d) Typical gas pressures are approximately atmospheric, which are obtainable and maintainable.

FIG. 1 shows a cross section view of an Electronic Safe and Arm Device (ESAD) 10 according to the present invention. Generally, ESAD 10 comprises a container or enclosure 11, circuit boards 14, 15, and 16, plus high voltage tube switch 17. Circuit board 14 could be a power conditioning board; circuit board 15 could be a safe and arm circuitry board; and circuit board 16 could be a fireset circuitry board.

Container 11 has a low voltage connector 12 for status or control signals and power hook up. A gas-fill pinch-off tube 13 is used on the end plate 9 of container 11 to facilitate pressurization with gas. The gas 18 for backfilling the container 11 is the same as the gas 19 used for the tube switch 17.

FIG. 2 shows a schematic representation of the present invention. The enclosure 11 forms the outer package for the ESAD and is filled under pressure with gas 18. The electronics circuit boards 14 and 15 are represented by the Safe and Arm electronics module 20. The fireset 16 circuit board includes the tube switch 17 with gas fill 19, a capacitor 21 for storing an electrical charge, a resistor 22 for slowly bleeding off any residual charge from capacitor 21 so it is always safe and a diode 23 for charging up the capacitor 21.

In FIG. 2, a hermetic connector 25 is shown in container 11. This connector channels the high voltage from the tube switch 17 to the detonator 26.

The following discussion will provide a better understanding of the operation of ESAD 10. During design, manufacturing and use, the ESAD is to provide safety of the explosives in a weapon. The capacitor 21 is kept discharged by resistor 22 until after the weapon is launched and the Safe and Arm device has been set to the Arm mode. This occurs after the sensing of some environmental change such as the increase in acceleration when the weapon is launched or an external signal such as disconnect of an umbilical line from a launch vehicle, or a time signal from a clock set at launch. Circuit board 15 of the electronics module 20 provides the controls for Arming. When the Arm signal has been set, the capacitor 21 is charged up through diode 23 by the power conditioning board 14. When the target has been detected, the Safe and Arm Electronics 20 sends a trigger signal to tube switch 17 on the fireset board 16 to detonate the explosive with detonator 26.

Presently available tube switches 17 are made with a ceramic body that acts as a dielectric to operate in the high voltage field, typically 2300 volts. The ends of the tube 17 are sealed with metal after filling the tube with a suitable gas mixture 19. The gas is to ensure that there is not a breakdown within the tube. Tube breakdown would result in the capacitor being discharged even before the trigger signal is sent to the tube. This could set off the detonator early and destroy the weapon launcher, e.g. airplane.

Enclosing the tube in a enclosure 11 allows filling the enclosure 11 with gas 18 that surrounds tube switch 17. For the present invention, the gases 18 and 19 are the same gas and at the same pressure.

Many tube switches use atmosphere pressure and a gas consisting of 89% nitrogen, 9% helium and 2% oxygen. The oxygen controls build up electrical conducting means, e.g. electrons, on surfaces in the tube switxh to prevent false turn-on of the tube switch. The container 11 is loaded with the ESAD and a vacuum pump (not shown) is used to purge the container using pinch tube 13 in end plate 9. The desired gas mixture 18 would be loaded in through the gas fill tube 13, which would then be pinched off to hold the pressure.

Low voltage connector 12 is hermetically sealed to maintain the gas pressure 18 in container 11. The connector provides for status signals from the ESAD to the weapon, input signals to the ESAD, and power from the weapon. The enclosure 11 may be laser welded or otherwise hermetically sealed to hold the gas pressure over the 10 to 20 years of possible shelf life. The hermetic connector 25 in FIG. 2 provides isolation for the detonator 26 and its associated explosives.

Another embodiment would be to isolate just the gas tube switch 17 in a small container that is pressurized or just some portions of the ESAD such as the fireset board 16. Putting the entire ESAD into a container has the advantage of providing a gas atmosphere for all the circuitry, which reduces the chance of arcing.

Another version of the present invention is the use of multiple detonators 26, 27, etc. as shown in FIG. 3. Multiple tube switches 17, 17', etc. can be incorporated into a hermetically sealed container 11. Safe and arm electronics 20, diode 23, resistor 22 and capacitor 21 are coupled in similar fashion to the circuit arrangement of FIG. 2 and these components operate in a similar fashion to their counterparts of FIG. 2. Safe and arm electronics 20 is coupled to tube switches 17 and 17' which include gases 19 and 19' of the nitrogen-helium mixture mentioned above. Typically tube switches 17 and 17' would be armed simultaneously, however they need not be armed together. The arming of each tube switch 17 and 17' is the same as that described above. For cases in which capacitor 21 is not able to provide sufficient charge to drive many detonators, separate drive circuits (e.g. diode 23, resistor 22 and capacitor 21) can be employed. That is, the drive circuit comprising diode 23, resistor 22 and capacitor 21 can be replicated, each replicate being used to drive a separate detonator.

The primary requirement that the present invention addresses is the high failure rating of present ESAD tube switches 17. One tube example is rated at a failure rate two times the missiles safety needs. The present invention, by providing a fault tolerant seal against the environment, can readily reduce the failure rate by more than two times.

The tube switch 17 leakage results from either environmental breakage or low leak rate of the switch tube ceramic to metal seal found in all the tube switches on the market. There are a minimum of two ceramic metal seals per tube switch. In addition, significant amounts of ammonia has been found in ESAD assemblies. The ammonia can act as a corrosive agent on the seals of the switch and increase the leak rate.

Care is required in the design of the ESAD since some materials may out gas and contaminate the gas 18 in enclosure 11. This could then pass into the switch gas 19 during long storage life. Any contaminants could reduce the voltage required to fire the tube and hence the safety of the ESAD.

The tube switch gas 19 is approximately atmospheric, which is about 14 pounds per square inch. When used in a missile that is carried on an aircraft to 50,000 feet, there is considerable pressure developed within the tube to out gas. Upon return from a mission where the missile was not used, there is now pressure in the other direction. The missile must be able to cycle through many such missions and then not fail when needed. By incorporating the tube switch 17 in a like gas 18, there would need to be two faults before the safety of the ESAD would expect to be compromised.

The present invention provides three distinct improvements over present art:

1) The tube switch 17 shelf life will be greatly extended since the proper gas 18 under the proper pressure will be maintained outside and within the gas 19 of tube switch 17;

2) The failure rate will be reduced from twice the safety requirement for some missile applications to better than required due to elimination of the gas leakage failure mode;

3) The survivability of the ESAD will be significantly enhanced since the tube switch can develop cracks during impact with the target and still function in the gas atmosphere provide by the backfilled container.

From the above explanation it can be seen that the present fault tolerant safe and arming device provides for a single fault tolerant safe and arming device. If the tube switch 17 fails and is exposed to the environment of the enclosure 11, no deterioration of the tube switch 17 will occur since the same gas mixture and pressure is in enclosure 11. Thus for a fault of the tube switch 17, the safe and arming device will operate properly since it will have the same environment even if the tube switch is exposed to the environment of the enclosure 11. Any environmental differences between the tube switch 17 and the enclosure 11 are negligible.

Further, should the enclosure 11 lose its environment, the tube switch 17 maintains its environment and as a result the safe and arming device will operate properly. Thus for any single fault of either the enclosure 11 or the tube switch 17, the safe and arming device will remain unaffected. Therefore the sought after benefits of a fault tolerant safe and arming device have been provided by the present invention.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. A fault tolerant safe and arming device comprising:

an enclosure having an inside;

a circuit affixed to said inside of said enclosure and said circuit operating to enable a detonator;

said circuit including a tube switch having a pressurized gas enclosed within said tube switch; and said enclosure being pressurized with a same gas as in said tube switch, such that for leakage of said tube switch a substantially constant gas mixture and pressure is maintained.

2. A fault tolerant safe and arming device as claimed in claim 1, wherein said pressurized gas and said same gas each comprise a mixture of approximately 89% nitrogen, 9% helium and 2% oxygen.

3. A fault tolerant safe and arming device as claimed in claim 1, wherein said circuit further includes a capacitor coupled to said tube switch, said capacitor for storing a charge to be transmitted through said tube switch.

4. A fault tolerant safe and arming device as claimed in claim 3, wherein said circuit further includes:

a resistor coupled in parallel with said capacitor and coupled to said tube switch; and a diode coupled to said tube switch and to said capacitor and to said resistor.

5. A fault tolerant safe and arming device as claimed in claim 3, wherein there is further included a safe and arming circuit coupled to said tube switch, said tube switch being operated in response to a trigger signal of said safe and arming circuit to enable said stored charge of said capacitor to be transmitted through said tube switch.

6. A fault tolerant safe and arming device as claimed in claim 5, wherein said detonator is coupled to said tube switch, said detonator operating in response to said charge transmitted through said tube switch to said detonator.

7. A fault tolerant safe and arming device comprising:

an enclosure having an inside which is sealable;

a circuit affixed to said inside of said enclosure and said circuit operating to enable at least one detonator;

said circuit including a plurality of tube switches having a pressurized gas enclosed within each of said plurality of tube switches; and said enclosure being pressurized with a same gas as in each of said plurality of tube switches, such that for leakage of any of said plurality of tube switches a substantially constant gas mixture and pressure is maintained.

8. A fault tolerant safe and arming device as claimed in claim 7, wherein said pressurized gas and said same gas each comprise a mixture of approximately 89% nitrogen, 9% helium and 2% oxygen.

9. A fault tolerant safe and arming device as claimed in claim 7, wherein said circuit further includes a capacitor coupled to each of said plurality of tube switches, said capacitor for storing a charge to be transmitted through each of said plurality of tube switches.

10. A fault tolerant safe and arming device as claimed in claim 9, wherein said circuit further includes:

a resistor coupled in parallel with said capacitor and coupled to each of said plurality of tube switches; and a diode coupled to each of said plurality of tube switches and to said capacitor and to said resistor.

11. A fault tolerant safe and arming device as claimed in claim 10, wherein there is further included safe and arming circuit coupled to each of said plurality of tube switches, each of said plurality of tube switches being operated in response to a trigger signal of said safe and arming circuit to enable said stored charge of said capacitor to be transmitted through each of said plurality of tube switches.

12. A fault tolerant safe and arming device as claimed in claim 11, wherein said at least one detonator includes a plurality of detonators corresponding to said plurality of tube switches, each of said plurality of tube switches coupled to a corresponding one of said plurality of detonators, each of said plurality of detonators operating in response to said charge transmitted through a corresponding one of said plurality of tube switches.

13. A method for providing a fault tolerant safe and arming device comprising the steps of:

providing a sealable enclosure having an inside;

affixing a circuit including a tube switch, having a pressurized gas within said tube switch, to said inside of said sealable enclosure, said circuit operating to enable a detonator;

sealing said sealable enclosure with an end plate; and pressurizing said sealable enclosure with a same gas and pressure as in said tube switch, such that for leakage of said tube switch a substantially constant gas mixture and pressure is maintained.

14. A method for providing a fault tolerant safe and arming device as claimed in claim 13 wherein said step of pressurizing includes the step of pressurizing said sealable enclosure with a gas of approximately 89% nitrogen, 9% helium and 2% oxygen.

15. A method for providing a fault tolerant safe and arming device as claimed in claim 13 wherein there is further included a step of operating, by said circuit, said tube switch to enable said detonator.

* * * * *